United States Patent [19]

Greenway et al.

[11] 4,364,156

[45] Dec. 21, 1982

[54] APPARATUS FOR HEATED PRESSURIZED FLUID STREAM TREATMENT OF SUBSTRATE MATERIAL

[75] Inventors: John M. Greenway, Spartanburg; Jimmy L. Stokes, Moore, both of S.C.

[73] Assignee: Milliken Research Corporation, Spartanburg, S.C.

[21] Appl. No.: 227,838

[22] Filed: Jan. 23, 1981

[51] Int. Cl.[3] ..... D06C 23/00

[52] U.S. Cl. ..... 26/2 R; 26/69 R; 26/69 A; 28/160; 28/163

[58] Field of Search ..... 26/2 R, 69 R, 69 A; 28/160, 163

[56] References Cited

U.S. PATENT DOCUMENTS 3,443,878 5/1969 Weber et al. ..... 28/163 X
4,323,760 4/1982 Greenway et al. ..... 26/2 R X

FOREIGN PATENT DOCUMENTS 978452 12/1964 United Kingdom ..... 28/163

*Primary Examiner*—Robert Mackey

*Attorney, Agent, or Firm*—George M. Fisher; H. Williams Petry

[57] ABSTRACT

Improved apparatus for treatment of relatively moving substrate materials by precise selective application of discrete, high temperature pressurized streams of fluid against the surface of the materials to impart a visual change thereto. The apparatus includes an elongate manifold for receiving pressurized heated fluid, such as air, disposed across the width of the relatively moving material and having a plurality of spaced parallel fluid stream discharge channels for directing the fluid into the surface of the material. Pressurized cool fluid, such as air, is directed into selected manifold discharge channels to block selectively the passage of pressurized heated air therethrough. The manifold is provided with heated air outlets which communicate by passageways with the manifold compartment to continuously bleed off heated air from the manifold, thereby counteracting localized cooling of the manifold adjacent the discharge channels and reducing pressure build up within the manifold when selected of the channels are blocked with the cool air.

5 Claims, 6 Drawing Figures

APPARATUS FOR HEATED PRESSURIZED FLUID STREAM TREATMENT OF SUBSTRATE MATERIAL

This invention relates to improved apparatus for pressurized heated fluid stream treatment of relatively moving materials to provide visual surface effects therein, and, more particularly, to improved apparatus for precise selective application of discrete, high temperature, pressurized streams of air or gaseous materials against the surface of a thermally modifiable, relatively moving substrate material, such as a textile fabric containing thermoplastic yarn or fiber components, to thermally modify the same and impart a visual change and/or pattern therein.

BACKGROUND OF THE INVENTION

Various apparatus have been proposed for directing heated pressurized fluid streams, such as air or stream, into the surface of moving textile fabrics to alter the location of or modify the thermal properties of fibers or yarns therein and provide a pattern or visual surface change in such fabrics. Examples of such prior art equipment and methods of application of the pressurized fluid streams to a relatively moving material are disclosed in the following U.S. Pat. Nos: 2,110,118; 2,241,222; 2,563,259; 3,010,179; 3,403,862; 3,434,188; 3,585,098; 3,613,186.

It is believed that such prior art treatment devices as described in the aforementioned patents, because of the nature of the equipment disclosed, are not capable of producing precise, intricate, or well defined patterns of wide variety in the fabrics, but generally can only produce limited, relatively grossly defined patterns, or surface modifications of a random, non-defined nature in the materials. In utilizing high temperature pressurized streams of fluid, such as air, to impart visual surface patterns to textile fabrics containing thermoplastic materials by thermal modification of the same, it can be appreciated that highly precise control of stream pressure, temperature, and direction is required in all of the individual heated streams striking the fabric to obtain uniformity and preciseness in the resultant pattern formed in the fabric. In addition, there are ever present difficulties in regulating the flow of high temperature fluid streams by use of conventional valving systems to selectively cut the stream flow on or off in accordance with pattern control information.

More recently, apparatus has been developed for more precisely and accurately controlling and directing high temperature streams of pressurized fluid, such as air, against the surface of a relatively moving substrate material, such as a textile fabric containing thermoplastic yarns, to impart intricate patterns and surface changes thereto. Such apparatus includes an elongate pressurized heated air distributing manifold having a narrow elongate air discharge slot extending across the path of fabric movement in close proximity to the fabric surface. Located within the manifold is a shim plate having a notched edge which resides in the discharge slot to form parallel spaced discharge channels through which the heated pressurized air passes in narrow, precisely defined streams to impinge upon the adjacent surface of the fabric. Flow of the individual heated air streams from the channels is controlled by the use of pressurized cool air which is directed by individual cool air supply tubes communicating with each channel to direct cool air into each discharge channel at a generally right angle to its discharge axis to block the passage of heated air therethrough. Each cool air tube is provided with an individual valve and the valves are selectively cut on and off in response to signal information from a pattern source, such as a computer program, to allow the heated air streams to strike the moving fabric in selected areas and impart a pattern thereto by thermal modification of the yarns.

To maintain more uniform temperature in the individual heated air streams along the full length of the distributing manifold, pressurized air is supplied to the distributing manifold through a bank of individual electric heaters which communicate with the manifold at uniformly spaced locations along its length and are regulated to introduce heated air at the desired temperature along the full length of the manifold.

Although such apparatus as described above provides for high precise and intricate hot air patterning of substrate materials, it can be appreciated that the temperature and pressure of each of the individual pressurized streams of high temperature air striking the surface of the substrate material must be uniform across the full width of the substrate being treated, otherwise irregular patterning of the substrate occurs. For example, in treatment of textile pile fabrics containing thermoplastic pile yarns, the streams of heated air striking the pile yarns in selected areas of the fabric cause the yarns to thermally deform, longitudinally shrink, and compact into the pile surface, forming narrow, precisely defined grooves or recesses which provide a desired patterned appearance in the pile surface. If the temperature or pressure in any of the air streams across the width of the fabric varies significantly from the others, the resultant patterned groove or recess formed thereby will be more or less pronounced in the pattern and correspondingly detract from the appearance of the final product.

When pressurized cool air is employed to block selected of the heated air discharge channels of the manifold to produce a desired pattern, as in the aforementioned apparatus, there is a momentary cooling of the manifold housing around the heated air discharge channel blocked by the cool air, resulting in a slight temperature drop in adjacent heated air streams striking the fabric, and a reduced temperature in the heated air stream discharged from the channel after it is unblocked. When a large number of discharge channels across the manifold are simultaneously blocked by cool pressurized air, the cooling effect on the manifold housing becomes more pronounced. In addition, a pressure build-up of heated air can occur in the manifold itself, causing undesired temperature and pressure variations in the heated air streams during the patterning operation, and contributing to overheating of the heater elements.

BRIEF OBJECTS OF THE INVENTION

It is therefore an object of the present invention to provide improved apparatus for uniformly patterning a relatively moving substrate material by selective application of heated pressurized fluid streams to the surface thereof.

It is another object to provide improved apparatus for heated fluid stream patterning of substrate materials employing heated fluid distributing manifold means having a plurality of pressurized heated fluid discharge outlets which are selectively blocked with pressurized cool fluid wherein means are provided for maintaining more uniform temperature and pressure in the fluid streams striking the substrate during the patterning operation.

It is a more specific object to provide an improved elongate pressurized heated fluid distributing manifold having a plurality of fluid stream discharge outlets which are selectively blocked by pressurized cool fluid for patterning substrate materials, and wherein the mamifold assembly is provided with additional heated fluid passageways and outlets adjacent the heated fluid stream discharge outlets to continuously warm the manifold assembly thereat and thereby maintain more uniform temperature and pressure in the streams, and reduce excess heat and pressure within the manifold, during patterning operations.

BRIEF DESCRIPTION OF THE INVENTION

Briefly, the present invention comprises improved fluid distributing manifold means for directing discrete streams of pressurized heated fluid, such as hot air, into the surface of a relatively moving substrate, in particular substrate materials containing thermoplastic components, to impart a precise pattern or surface change thereto.

The manifold means includes an elongate manifold housing which is disposed across the path of movement of the substrate material and has a plurality of heated fluid discharge outlets spaced along the manifold for discharging pressurized streams of heated fluid, such as hot air, into the surface of the substrate across its width to thermally modify and alter the surface appearance of the substrate. Discharge of the streams of heated air from the manifold housing outlets is controlled by selectively introducing a pressurized fluid, such as air, having a temperature substantially lower than the temperature of the heated air, into the discharge channel of each heated air discharge outlet to block the passage of heated air therethrough. The pressurized cool air is introduced into each hot air discharge channel at a substantially right angle to its discharge axis by an individual cool air supply line which is provided with a control valve operated in accordance with pattern information to activate and deactivate the flow of pressurized cool air to the heated air discharge channels.

To counteract the localized cooling of the manifold housing by the blocking cool air, the housing is provided with a plurality of hot air outlets located between the heated air discharge channels which communicate by passageways with the manifold housing compartment to allow a continuous bleed off of a small amount of heated air from the housing compartment. This heated bleed off air contacts the wall portions of the manifold housing adjacent the heated air discharge channels to heat the same, thus reducing the aforementioned localized cooling effect and minimizing the time necessary to re-establish a satisfactory heated air stream in a previously blocked channel, thereby avoiding resultant patterning irregularities in the substrate material resulting therefrom.

In addition, continuous bleed-off of heated air from the manifold housing during patterning prevents overheating of the heaters and reduces pressure build up of heated air in the manifold housing when the heated air streams are blocked by the cool air.

BRIEF DESCRIPTION OF THE DRAWINGS

Objects and details of the invention will be better understood from the following detailed description of a preferred embodiment thereof, when taken together with the accompanying drawings, in which.

DETAILED DESCRIPTION OF PREFERRED EMBODIMENTS

Figure 1:
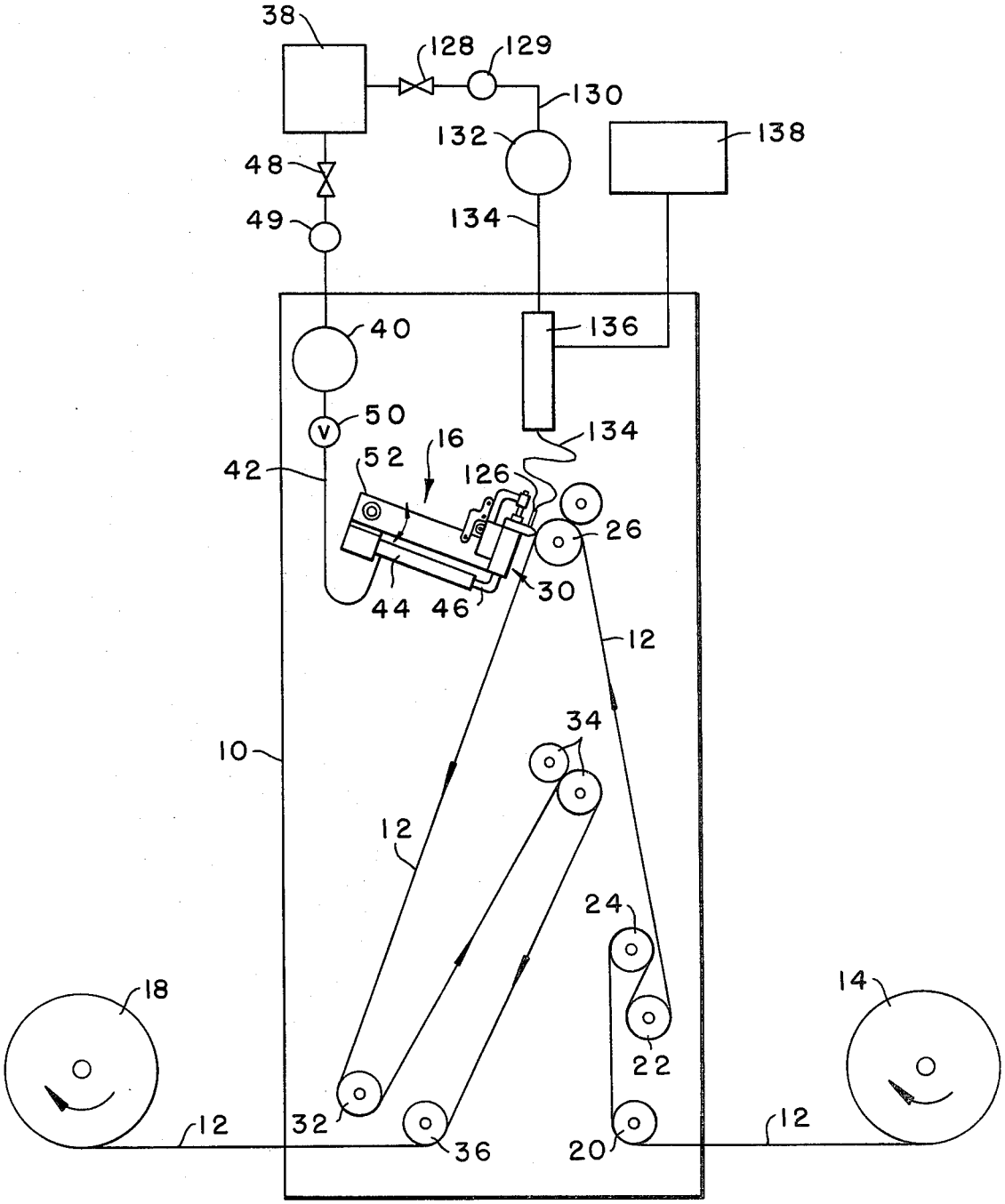
FIG. 1 is a schematic side elevation view of apparatus for pressurized heated fluid stream treatment of a moving substrate material to impart a surface pattern or change in the surface appearance thereof, and incorporating novel features of the present invention.

Referring more specifically to the drawings, FIG. 1 shows, diagrammatically, an overall side elevation view of apparatus for pressurized heated fluid stream treatment of a moving substrate material to impart a pattern or visual change thereto. As seen, the apparatus includes a main support frame including end frame support members, one of which 10 is illustrated in FIG. 1. Suitably rotatably mounted on the end support members of the frame are a plurality of substrate guide rolls which direct an indefinite length substrate material, such as a textile fabric 12, from a fabric supply roll 14, past a pressurized heated fluid treating unit, generally indicated at 16. After treatment, the fabric is collected in continuous manner on a take-up roll 18. As shown, fabric 12 from supply roll 14 passes over an idler roll 20 and is fed by a pair of driven rolls 22, 24 to a main driven fabric support roll 26 to pass the surface of the fabric closely adjacent the heated fluid discharge outlets of an elongate fluid distributing manifold assembly 30 of treating unit 16. The treated fabric 12 thereafter passes over a series of driven guide rolls 32, 34 and an idler roll 36 to take up roll 18 for collection.

As illustrated in FIG. 1, fluid treating unit 16 includes a source of compressed fluid, such as an air compressor 38, which supplies pressurized air to an elongate air header pipe 40. Header pipe 40 communicates by a series of air lines 42 spaced uniformly along its length with a bank of individual electrical heaters indicated generally at 44. The heaters 44 are arranged in parallel along the length of manifold assembly 30 and supply heated pressurized air thereto through short, individual air supply lines, indicated at 46, which communicate with assembly 30 uniformly along its full length. Air supply to the fluid distributing manifold assembly is controlled by a master control valve 48, pressure regulator valve 49, and individual precision control valves, such as needle valves 50, located in each heater air supply line 42. The heaters are controlled in suitable manner, as by temperature sensing means located in the outlet lines 46 of each heater, with regulation of air flow and electrical power to each of the heaters to maintain the heated fluid at a uniform temperature and pressure as it passes into the manifold assembly along its full length. Typically, for patterning textile fabrics, such as pile fabrics containing thermoplastic pile yarns, the heaters are employed to heat air exiting the heaters and entering the manifold assembly to a uniform temperature of about 700° F.–750° F.

The heated fluid distributing manifold assembly 30 is disposed across the full width of the path of movement of the fabric and closely adjacent the surface thereof to be treated. Although the length of the manifold assembly may vary, typically in the treatment of textile fabric materials, the length of the manifold assembly may be 76 inches or more to accommodate fabrics of up to about 72 inches in width.

Figures 5, 6:
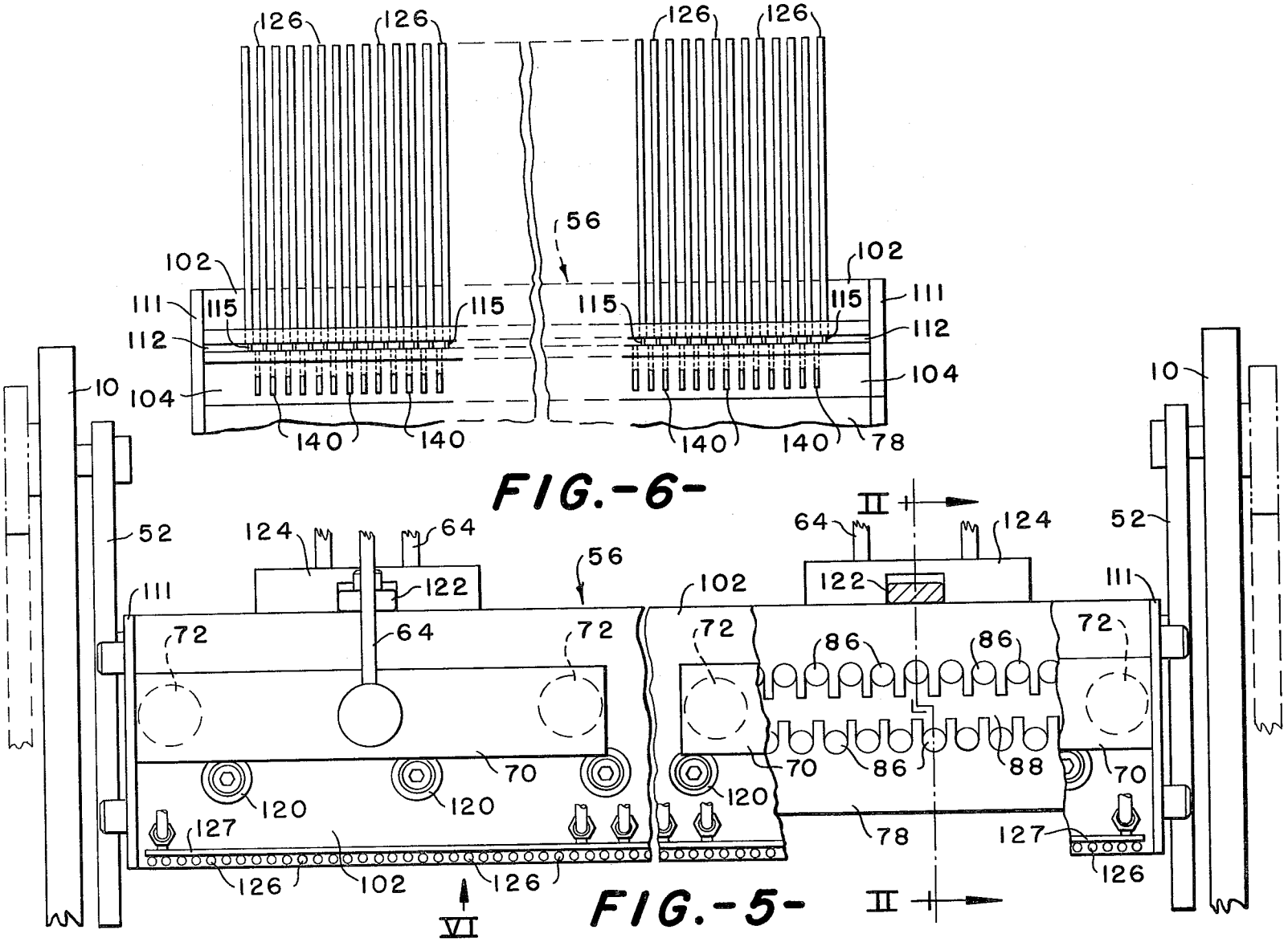
FIG. 5 is an enlarged plan view of end portions of the manifold assembly, with portions broken away and in section, taken generally along line V—V of FIG. 2 looking in the direction of the arrows.
FIG. 6 is a front elevation view of the fluid distributing manifold housing looking in the direction of arrow VI in FIG. 5.

As illustrated in FIGS. 1 and 5, the elongate manifold assembly 30 and the bank of heaters 44 are supported at their ends on the end frame support members 10 of the main support frame by support arms 52 which are pivotally attached to end members 10 to permit movement of the assembly 30 and heaters 44 away from the surface of the fabric 12 and fabric supporting roller 26 during periods when the movement of the fabric through the treating apparatus may be stopped.

Figure 2:
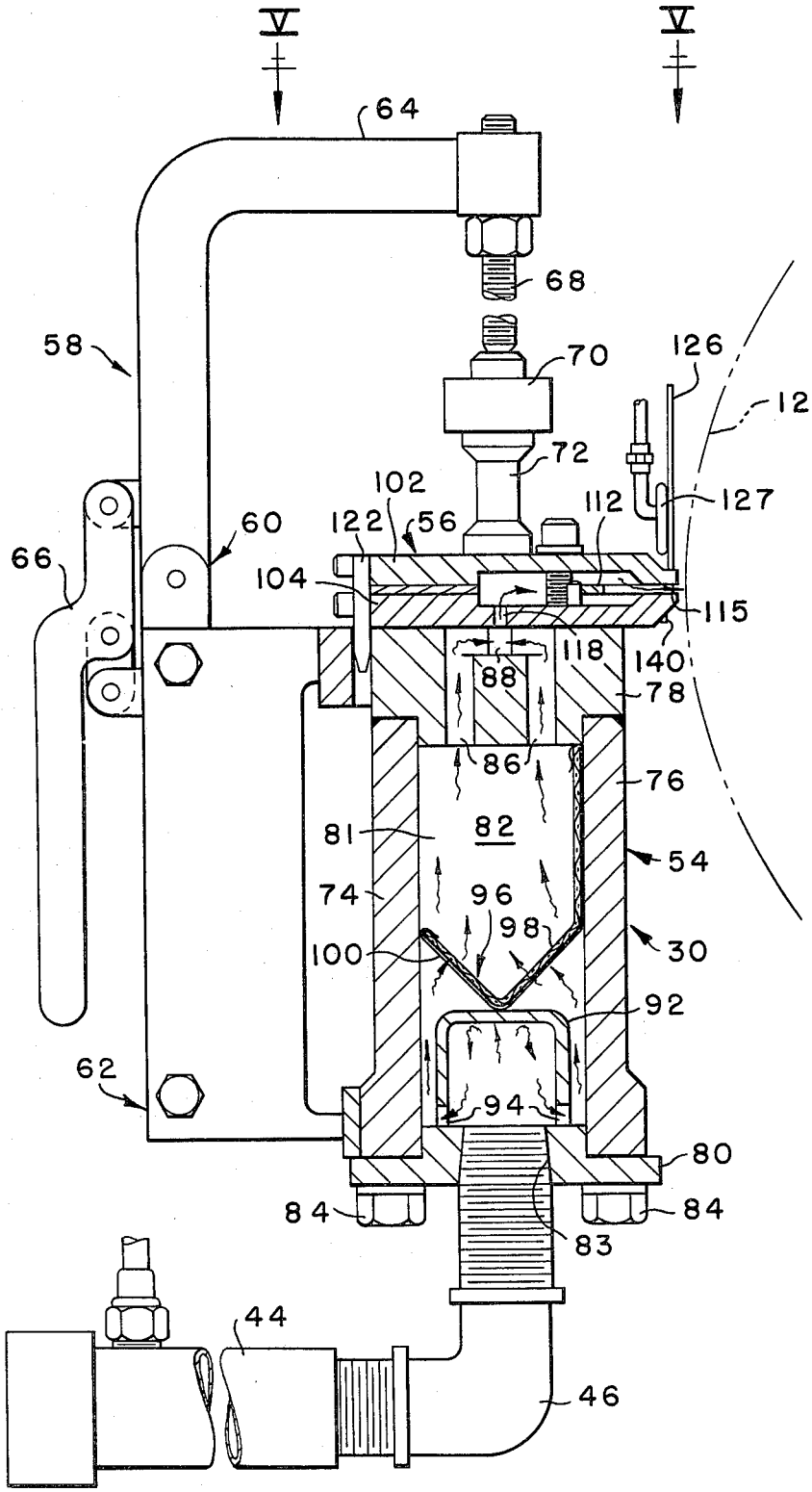
FIG. 2 is an enlarged partial sectional elevation view of the fluid distributing manifold assembly of the apparatus of FIG. 1, taken along a section line of the manifold assembly indicated by the line II—II in FIG. 5.

Details of the heated fluid-distributing manifold assembly may be best described by reference to FIGS. 2–6 of the drawings. As seen in FIG. 2, which is a partial sectional elevation view through the assembly, taken along line II—II of FIG. 5, the manifold assembly 30 comprises a first large elongate manifold housing 54 and a second smaller elongate manifold housing 56 secured in fluid tight relationship therewith by a plurality of spaced clamping means, one of which is generally indicated at 58. The manifold housings 54, 56 extend across the full width of the fabric 12 adjacent its path of movement. Clamping means 58 comprises a plurality of manually-operated clamps 60 spaced along the length of the housings. Each clamp includes a first portion 62 fixedly attached, as by welding, to the first manifold housing 54, and a second movable portion 64 pivotally attached to fixed portion 62 by a manually operated handle and linkage mechanism 66. Second portion 64 of clamp 60 includes an adjustable threaded screw and bolt assembly 68 with elongate presser bars 70 which apply pressure to manifold housing 56 through a plurality of spacer blocks 72 which are attached to the surface of housing 56 at spaced locations along its length (FIG. 5).

As best seen in FIG. 2, first elongate manifold housing 54 is of generally rectangular cross-sectional shape, and includes a pair of spaced plates forming side walls 74, 76 which extend across the full width of the path of fabric movement, and elongate top and bottom wall plates 78, 80 which define a first elongate fluid receiving compartment 81, the ends of which are sealed by end wall plates 82 suitably bolted thereto. Communicating with bottom wall plate 80 through fluid inlet openings, one of which, 83, is shown in FIG. 2, spaced uniformly therealong are the air supply lines 46 from each of the electrical heaters 44. The side walls 74, 76 of the housing are connected to top wall plate 78 in suitable manner, as by welding, and the bottom wall plate 80 is removably attached to side walls 74, 76 by bolts 84 to permit access to the fluid receiving compartment. The plates and walls of the housing 54 are formed of suitable high strength material, such as stainless steel, or the like.

The manifold housings 54, 56 are constructed and arranged so that the flow path of fluid through the first housing 54 is generally at a right angle to the discharge axes of the fluid stream outlets of the second manifold housing 56. In addition, the mass comprising side walls 74, 76 and top and bottom wall plates 78, 80 of first manifold housing 54 is substantially arranged on opposing sides of a plane bisecting the first fluid receiving compartment 81 in a direction parallel to the elongate length of manifold housing 54 and parallel to the predominant direction of fluid flow, i.e., from inlet openings 83 to passageways 86, through the housing compartment 81. Because the mass of the first housing 54 is arranged in a generally symmetrical fashion with respect to the path of the heated fluid through the housing compartment 81, thermal gradients and the resulting thermally-induced distortions in the first housing 54 also tend to be similarly symmetrical. As a consequence, any distortion of the manifold assembly caused by expansion and contraction due to temperature differentials tends to be resolved in a plane generally parallel to the surface of the textile fabric 12 being contacted by the heated fluid streams. This resolution of movement of the manifold assembly minimizes any displacement of the manifold discharge outlet channels 115 toward or away from the fabric 12 as a result of non-uniform thermal expansion of the manifold assembly. Any remaining unresolved thermally-induced displacement of the manifold housing 54 may be corrected by the use of jacking members or other means to supply corrective forces directly to the manifold housing.

Figure 3:
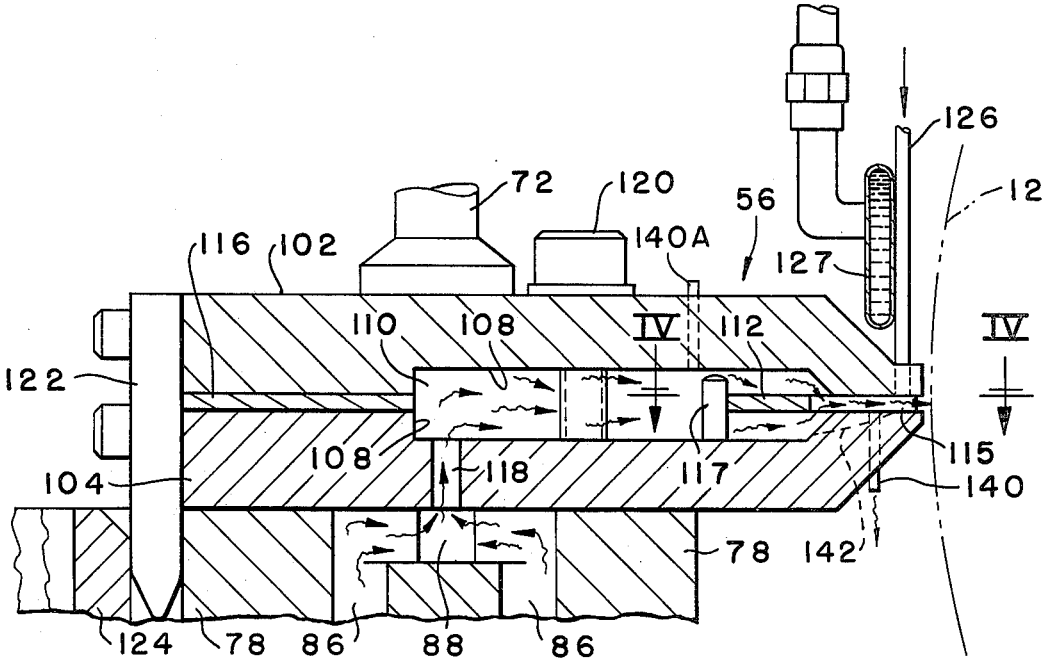
FIG. 3 is an enlarged broken away sectional view of the fluid stream distributing manifold housing of the manifold assembly as illustrated in FIG. 2.

As best seen in FIGS. 2, 3 and 5, upper wall plate 78 of manifold housing 54 is of relatively thick construction and is provided with a plurality of fluid flow passageways 86 which are disposed in uniformly spaced relation along the plate in two rows to communicate the first fluid receiving compartment 81 with a central elongate channel 88 in the outer face of plate 78 which extends between the passageways along the length of the plate 78. As seen in FIG. 5, the passageways in one row are located in staggered, spaced relation to the passageways in the other row to provide for uniform distribution of pressurized air into the central channel 88 while minimizing strength loss of the elongate plate 78 in the overall manifold assembly.

As seen in FIG. 2, located in first fluid receiving compartment 81 and suitably attached to the bottom wall plate 80 of the housing 54, as by threaded bolts (not shown), is an elongate channel-shaped baffle plate 92 which extends along the length of the compartment 81 in overlying relation to wall plate 80 and the spaced, fluid inlet opening 83. Baffle plate 92 serves to define a fluid receiving chamber in the compartment 81 having side openings or slots 94 adjacent wall plate 80 to direct the incoming heated air from the bank of heaters in a generally reversing path of flow through compartment 81. As seen in FIG. 2, disposed above channel-shaped baffle plate 92 in compartment 81 between the fluid inlet openings 83 and fluid outlet passageways 86 is an elongate filter member 96 which consists of a perforated, generally J-shaped plate 98 with filter screen 100 disposed thereabout. Filter member 96 extends the length of the first fluid receiving compartment 81 and serves to filter foreign particles from the heated pressurized air during its passage therethrough. Access to the compartment 81 by way of removable bottom wall plate 80 permits periodic cleaning and/or replacement of the filter member, and the filter member is maintained in position in the compartment 81 by frictional engagement with the side walls 74, 76 to permit its quick removal from and replacement in the compartment 81.

Figure 4:
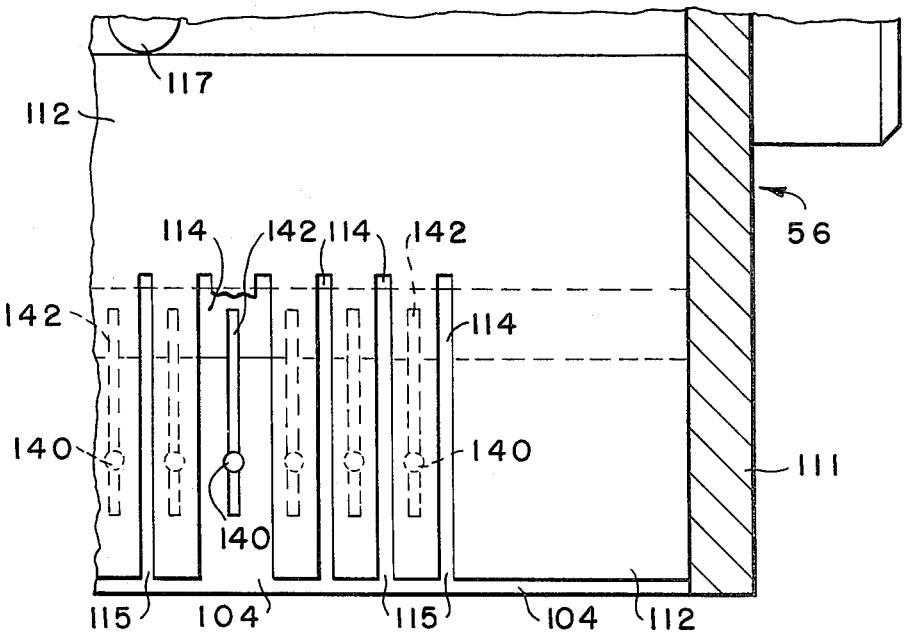
FIG. 4 is an enlarged broken away, sectional view of an end portion of the fluid stream distributing manifold housing looking in the direction of the arrows IV—IV of FIG. 3; p

As seen in FIGS. 2–6, second smaller manifold housing 56 comprises first and second opposed elongate wall members 102, 104, each of which has an elongate recess or channel 108 therein. Wall members 102, 104 are disposed in spaced, coextensive parallel relation with their recesses 108 in facing relation to form upper and lower wall portions of a second fluid receiving compartment 110, in the second manifold housing 56. Ends of the second fluid receiving compartment 110 are closed by end plates 111 (FIG. 5). The opposed wall members 102, 104 are maintained in spaced relation by an elongate front shim plate 112 which has a plurality of parallel, elongate notches 114 (FIG. 4) in one side edge thereof, and a rear elongate shim plate 116 disposed between the opposed faces of the wall members 102, 104 in fluid tight engagement therewith. As seen in FIGS. 3 and 4, the notched edge of shim plate 112 is disposed between the first and second wall members along the front elongate edge portions thereof to form, with wall members 102, 104, a plurality of parallel heated fluid discharge outlet channels 115 which direct heated pressurized air from the second fluid receiving compartment 110 in narrow, discrete streams at a substantially right angle into the surface of the moving fabric substrate material 12. Dowel pins 117 (FIGS. 3 and 4) in fluid receiving compartment 110 facilitate alignment of shim plate 112 between wall members 102, 104. Typically, in treatment of textile fabrics, such as pile fabrics containing thermoplastic pile yarn or fiber components, the discharge channels 115 of manifold 56 may be 0.012 inch wide and uniformly spaced on 0.1 inch centers with 756 discharge channels being located in a row alonga 76 inch long manifold assembly. For precise control of the heated air streams striking the fabric, the discharge outlet channels are preferably maintained between about 0.020 to 0.030 inch from the fabric surface being treated.

Lower wall member 104 of the second manifold housing 56 is provided with a plurality of spaced fluid inlet openings 118 (FIGS. 2 and 3) which communicate with the elongate channel 88 of the first manifold housing 54 along its length to receive pressurized heated air from the first manifold housing into the second fluid receiving compartment 110. Wall members 102, 104 of the second manifold housing 56 are connected at spaced locations by a plurality of threaded bolts 120, and the second manifold housing 56 is maintained in fluid tight relation with its shim members and with the elongate channel 88 of the first manifold housing 54, by the adjustable clamps 60. Guide means, comprising a plurality of short guide bars 122 attached to the second manifold housing 56 and received in guide bar openings in brackets 124 attached to the first manifold housing 54, ensure proper alignment of the first and second manifold housings during their attachment by the quick-release clamps.

Each of the heated fluid discharge outlet channels 115 of the second manifold housing 56 which direct streams of air into the surface of fabric 12 is provided with a tube 126 which communicates at a right angle to the axis of the discharge channel to introduce pressurized cool air, i.e., air having a temperature substantially below that of the heated air in second fluid receiving compartment 110, into the heated fluid discharge outlet channel to selectively block the flow of heated air through the channel in accordance with pattern control information. Air passing through the tubes 126 may be cooled by a water jacket 127 which is provided with cooling water from a suitable source, not shown. As seen in FIG. 1, pressurized unheated air is supplied to each of the tubes 126 from compressor 38 by way of a master control valve 128, pressure regulator valve 129, air line 130, and unheated air header pipe 132 which is connected by a plurality of individual air supply lines 134 to the individual tubes 126. Each of the individual cool air supply lines 134 is provided with an individual control valve located in a valve box 136. These individual control valves are operated to open or close in response to signals from a pattern control device, such as a computer 138, to stop the flow of hot air through selected discharge channels 115 during movement of the fabric and thereby produce a desired pattern in the fabric. Detailed patterning information for individual patterns may be stored and accessed by means of any known data storage medium suitable for use with electronic computers, such as magnetic tape, EPROMS, etc.

The foregoing details of the construction and operation of the manifold assembly 30 of the fluid treating apparatus is the subject matter of copending commonly assigned U.S. patent applications of different inventive entities, and the disclosure thereof is included herein for full description and clear understanding of the improved features of the present invention.

The improved features of the present invention may best be described by reference to FIGS. 3, 4 and 6 of the drawings. As seen, located in the lower wall member 104 between each of the pressurized heated fluid discharge outlet channels 115 is a fluid outlet tube 140. Each outlet tube 140 is in continuous communication with the fluid receiving compartment 110 of housing 56 by a passageway 142 formed by an arcuate groove cut into the upper surface of lower wall member 104 between each discharge outlet channel 115 formed by the wall members and shim plate 112. Each of the fluid outlet tubes 140 is positioned at a right angle or greater to the axes of discharge of the outlet channels 115, as measured from that portion of the outlet channel closest to the fabric surface, to continuously bleed off a portion of heated pressurized air from the fluid receiving compartment 110 through passageways 142 and to direct the same away from the surface of the moving fabric 12 (FIG. 3). The continuous flow of hot air through passageways 142 which extend parallel to channels 115, heats the wall portions of the manifold housing 56 and surface portions of the shim plate 112 between the discharge channels to counteract the cooling of the same when pressurized cool air is introduced into the channels for blocking heated air stream discharge therefrom.

By continuously bleeding off a portion of pressurized heated air from the fluid receiving compartment 110, excess heat and pressure which build up in the compartment during blocking of the discharge channels 115 is reduced to minimize pattern distortions in the fabric resulting therefrom. Continuous bleed off of hot air from the manifold compartment also reduces the frequency of regulation of power to the individual heaters 44 to maintain air at a desired temperature entering the manifold assembly 30, and prevents possible overheating or burn out of the heaters when air flow therethrough could be reduced by excessive pressure build up in compartment 110.

The amount of air continuously bled off from the fluid receiving compartment 110 through tubes 140 may be varied by use of tubes of varying internal cross-sectional area. Typically, for patterning textile fabrics containing thermally deformable components, it has been found that improved results in pattern uniformity have been achieved when the total internal cross-sectional area of the outlet tubes 140 is about one-half or more of the total cross-sectional area of the discharge outlet channels 115 of the manifold housing 56.

Under certain conditions, it may not be necessary to heat the manifold housing 56 and shim plate 112 to counteract the effect of the blocking stream of pressurized cool air from tubes 125. However, where the use of such blocking streams could result in a build-up of heat and pressure sufficient to shorten heater life or induce problems in power regulation, it is foreseen that tubes 140 may be located so as to exit heated air from compartment 110 from any convenient location, such as depicted at 140A of FIG. 3.

From the foregoing description, it can be seen that the improvements of the present invention minimize temperature and pressure variations occurring in heated pressurized fluid stream patterning apparatus utilizing pressurized cool air for selectively blocking the streams to reduce and/or eliminate pattern distortions in substrate materials treated thereby.

That which we claim is:

1. In apparatus for treating a relatively moving substrate material by application of discrete streams of pressurized heated fluid to selected surface portions of the substrate to impart a visual effect thereto, and including an elongate fluid distributing manifold positioned across the path of relative movement of the substrate, said manifold defining an elongate fluid receiving compartment and a plurality of fluid discharge outlet channels disposed in parallel spaced relation along the compartment to direct discrete streams of pressurized fluid against the surface of the relatively moving substrate, and means for directing pressurized cool fluid into selected of the heated fluid discharge outlet channels to selectively block the passage of heated fluid therethrough; the improvement therewith comprising fluid passage means for directing pressurized heated fluid from said fluid receiving compartment through wall portions of the manifold adjacent the fluid discharge outlet channels to heat the wall portions adjacent the channels.

2. Apparatus as defined in claim 1 wherein said passage means includes a heated fluid outlet in said manifold located between each of said discharge channels, and a passageway communicating each outlet with said elongate fluid receiving compartment to permit continuous flow of heated fluid in the compartment through the passageway and from the manifold.

3. Apparatus as defined in claim 2 wherein said manifold includes a pair of elongate wall members extending across the path of relative movement of the substrate material in opposed spaced relation and with opposed elongate edge portions of the wall members defining an elongate slot therebetween, an elongate shim plate having a notched side edge and positioned with said notched side edge within said slot to define with said edge portions of the wall members said discharge outlet channels of the manifold, and wherein said passageways and said fluid outlets communicate with surface portions of said shim plate between said channels to continuously heat the same and reduce cooling thereof by pressurized cool fluid employed to block selected of the discharge channels of the manifold.

4. Apparatus as defined in claim 3 wherein said passageways and fluid outlets are located in an elongate edge portion of one of said wall members, and wherein the axis of discharge of heated fluid from each of said outlets defines an angle of at least about 90° with the axes of discharge of heated fluid streams from said discharge channels, as measured from that portion of the outlet channel closest to the substrate surface, to direct heated fluid from said manifold outlets away from the surface of the relatively moving substrate material.

5. Apparatus as defined in claim 4 wherein said passageways extend generally parallel to the manifold discharge outlet channels and communicate along their length with surface portions of said shim plate between said notches therein, and wherein said fluid outlets include tubes communicating with said passageways and terminating beyond said manifold one wall member.

* * * * *